US010758917B2

(12) United States Patent
Inoue

(10) Patent No.: US 10,758,917 B2
(45) Date of Patent: Sep. 1, 2020

(54) COAL PULVERIZING APPARATUS, CONTROL DEVICE AND CONTROL METHOD FOR SAME, AND COAL-FIRED POWER PLANT

(71) Applicant: Mitsubishi Hitachi Power Systems, Ltd., Yokohama-shi, Kanagawa (JP)

(72) Inventor: Rikio Inoue, Tokyo (JP)

(73) Assignee: MITSUBISHI HITACHI POWER SYSTEMS, LTD., Yokohama-shi, Kanagawa (JP)

( * ) Notice: Subject to any disclaimer, the term of this patent is extended or adjusted under 35 U.S.C. 154(b) by 136 days.

(21) Appl. No.: 16/095,823

(22) PCT Filed: Feb. 7, 2017

(86) PCT No.: PCT/JP2017/004430

§ 371 (c)(1),
(2) Date: Oct. 23, 2018

(87) PCT Pub. No.: WO2017/195417

PCT Pub. Date: Nov. 16, 2017

(65) Prior Publication Data

US 2019/0168234 A1 Jun. 6, 2019

(30) Foreign Application Priority Data

May 13, 2016 (JP) ..... 2016-097131

(51) Int. Cl.
*F23K 1/00* (2006.01)
*B02C 25/00* (2006.01)
(Continued)

(52) U.S. Cl.
CPC ..... *B02C 25/00* (2013.01); *B02C 15/001* (2013.01); *B02C 15/04* (2013.01); *F23K 3/02* (2013.01); *B02C 2015/002* (2013.01)

(58) Field of Classification Search
CPC . B02C 2015/002; B02C 15/001; B02C 15/04; B02C 15/007; B02C 15/00;
(Continued)

(56) References Cited

U.S. PATENT DOCUMENTS

| | | | |
|---|---|---|---|
| 5,875,977 | A | 3/1999 | Kozlak et al. |
| 2010/0326337 | A1 | 12/2010 | Tsutsumi et al. |
| 2013/0061787 | A1 | 3/2013 | Iida et al. |

FOREIGN PATENT DOCUMENTS

| | | | |
|---|---|---|---|
| CN | 102905790 | A | 1/2013 |
| JP | S59-164820 | A | 9/1984 |

(Continued)

OTHER PUBLICATIONS

International Search Report dated Apr. 4, 2017, issued in counterpart application No. PCT/JP2017/004430, with English translation. (14 pages).

(Continued)

*Primary Examiner* — Jason Lau
(74) *Attorney, Agent, or Firm* — Westerman, Hattori, Daniels & Adrian, LLP

(57) ABSTRACT

A control device for the coal pulverizing apparatus includes a first command value generation part for generating a command value of a first parameter including at least one of rotational speed of the table, pressing force of the roller to the table, or air supply amount in the air supply part, and a second command value generation part for generating a command value of a second parameter including a rotational speed of the rotary classifier. The first command value generation part is configured to determine the command value of the first parameter, based on a first preceding signal determined in accordance with at least load information of a combustion device which burns the pulverized coal from the coal pulverizing apparatus. The second command value generation part determines the command value of the second
(Continued)

parameter, based on a second preceding signal determined in accordance with at least the load information.

14 Claims, 6 Drawing Sheets

(51) Int. Cl.
*B02C 15/04* (2006.01)
*F23K 3/02* (2006.01)
*B02C 15/00* (2006.01)

(58) Field of Classification Search
CPC ..... B02C 23/10; B02C 25/00; B02C 15/006; B02C 23/30; B02C 15/004; B02C 23/08; B02C 23/12; B02C 13/2804; B02C 21/00; B02C 23/04; B02C 13/04; B02C 13/10; B02C 13/26; B02C 23/32; B02C 13/12; B02C 13/13; B02C 13/22; B02C 15/003; B02C 15/12; B02C 19/186; B02C 21/02; B02C 23/24; B02C 23/34; B02C 2/04; B02C 17/1845; B02C 17/00; B02C 17/187; B02C 15/02; B02C 17/04; B02C 17/1805; B02C 19/005; B02C 19/063; B02C 23/00; B02C 15/14; B02C 2015/008; B02C 15/045; B02C 23/26; F23K 2201/1006; F23K 2203/104; F23K 2201/10
See application file for complete search history.

(56) References Cited

FOREIGN PATENT DOCUMENTS

| | | | |
|---|---|---|---|
| JP | S60-020021 | A | 2/1985 |
| JP | S63-062556 | A | 3/1988 |
| JP | H02-157053 | A | 6/1990 |
| JP | H03-102243 | U | 10/1991 |
| JP | H04-093511 | A | 3/1992 |
| JP | H04-145957 | A | 5/1992 |
| JP | H04-334563 | A | 11/1992 |
| JP | H08-243429 | A | 9/1996 |
| JP | 2001-117606 | A | 4/2001 |
| JP | 2010-104939 | A | 5/2010 |
| JP | 2012-007811 | A | 1/2012 |
| JP | 2012-81374 | A | 4/2012 |
| JP | 2015-100740 | A | 6/2015 |
| TW | 449504 | B | 8/2011 |

OTHER PUBLICATIONS

Notification of Transmittal of Translation of the International Preliminary Report on Patentability (Forms PCT/IB/338) issued in counterpart International Application No. PCT/JP2017/004430 dated Nov. 22, 2018 with Forms PCT/IB/373, PCT/IB/326, and PCT/ISA/237. (20 pages).

Office Action dated Aug. 18, 2017, issued in counterpart Japanese application No. 2016-097131, with English translation. (9 pages).

Office Action dated Jan. 9, 2018, issued in counterpart Taiwanese application No. 106105600. (9 pages).

COAL PULVERIZING APPARATUS, CONTROL DEVICE AND CONTROL METHOD FOR SAME, AND COAL-FIRED POWER PLANT

TECHNICAL FIELD

The present disclosure relates to a coal pulverizing apparatus for pulverizing coal, a control device and a control method for controlling the same, and a coal-fired power plant.

BACKGROUND ART

For instance, a coal-fired power plant generates electric power by burning coal particles pulverized by a coal pulverizing apparatus with a furnace to produce a combustion gas, generating steam through heat exchange with the combustion gas, and driving a turbine by the steam.

The load of the coal-fired power plant is not always constant. The coal-fired power plant can be operated with the change in load. For instance, in a case where the coal-fired power plant is connected to a utility grid, it is desired to rapidly change the load of the coal-fired power plant in response to a demand of the utility grid, for stabilizing the utility grid frequency or other purposes.

In the coal-fired power plant, however, even if the amount of coal (raw material coal) supplied to the coal pulverizing apparatus is changed, there is a time lag (coal output delay) until the coal output, i.e., the amount of coal discharged from the coal pulverizing apparatus is changed. It is therefore difficult to rapidly change the load of the coal-fired power plant.

In this regard, Patent Document 1 discloses that the rotational speed of a table is determined based on a coal supply amount command value and a parameter related to the change in the load of a generator in order to overcome the coal output delay.

Patent Document 2 discloses a method for controlling a vertical mill, including changing the coal supply amount in accordance with an increase/decrease in load of the vertical mill and changing the rotational speed of a table to cover the lack or excess of the coal discharge amount due to the time delay between coal supply and coal discharge.

Patent Document 3 discloses that the coal supply amount and the rotational speed of a classifier are controlled in response to a load correction signal obtained based on dynamic characteristic of the coal discharge amount when the output command is changed followed by the change of parameters such as the moisture or the hardness of coal, a primary air flow rate, and the rotational speed of the classifier.

Patent Document 4 discloses a method for controlling a coal pulverizing apparatus, including subtracting an output demand signal from a signal obtained by inputting the output demand signal into a first-order lag operator to generate a correction signal, processing the correction signal by a limiter and an integrator, and adding a signal generated from a constant generator to generate a rotational speed command for a rotary separator (rotary classifier) in accordance with a load state. The constant generator is configured to set the rotational speed of the rotary separator (rotary classifier) to a fixed value.

Patent Document 5 discloses a method for controlling a coal pulverizing apparatus including a main operation circuit which calculates a command signal associated with the coal supply amount on the basis of detection data from a boiler or a generator, an additional control unit which calculates the deviation between a standard coal output pattern preset in the coal pulverizing apparatus and a current coal output pattern, in which a calculation result by the additional control unit is added to the main operation circuit as a correction signal.

Patent Document 6 discloses a pulverized coal supply system in which at least one manipulated value of a mill, a primary air conveying part, or a coal supply part is determined based on a coal output (coal discharge amount) determined based on driving conditions of the mill and output power necessary for a furnace.

Patent Document 7 discloses that even when the temperature of an outlet of a coal pulverizer is changed due to a control of the opening degree of a conveying-air-flow-rate adjustment damper at the change in load, a coal output temperature correction signal is determined based on the deviation between a detected temperature and a set temperature of the outlet of the coal pulverizer, and the coal output temperature correction signal is used for controlling the opening degree of the conveying-air-flow-rate adjustment damper to ensure the coal discharge amount in response to a coal discharge amount command signal.

CITATION LIST

Patent Literature

Patent Document 1: JP2015-100740A
Patent Document 2: JPS63-62556A
Patent Document 3: JPH8-243429A
Patent Document 4: JPH4-334563A
Patent Document 5: JP2010-104939A
Patent Document 6: JP2012-7811A
Patent Document 7: JPH4-93511A

SUMMARY

Problems to be Solved

However, a higher load change rate is becoming necessary in the coal-fired power plant. The coal pulverizing apparatuses disclosed in Patent Documents 1 to 7 are insufficient to improve the coal output delay in some cases.

At least some embodiments of the present invention were made in view of the above problems. An object thereof is to provide a coal pulverizing apparatus, a control device and a control method for controlling the same, and a coal-fired power plant, whereby it is possible to improve the output delay of coal.

Solution to the Problems (1) A control device for a coal pulverizing apparatus according to at least some embodiments of the present invention is used for a coal pulverizing apparatus including a rotatable table, a roller configured to pulverize a coal supplied from the table, a rotary classifier configured to classify a pulverized coal obtained by pulverizing the coal with the roller, and an air supply part configured to generate an air flow for guiding the pulverized coal toward the rotary classifier, the control device comprising: a first command value generation part configured to generate a command value of a first parameter including at least one of a rotational speed of the table, a pressing force of the roller to the table, or an air supply amount in the air supply part; and a second command value generation part configured to generate a command value of a second parameter including at least a rotational speed of the rotary classifier, the first command value generation part being configured to determine the command value of the first parameter, based on a first preceding signal determined in accordance with at least load information of a combustion device which burns the pulverized coal from the coal pulverizing apparatus, the second command value generation part being configured to determine the command value of the second parameter, based on a second preceding signal determined in accordance with at least the load information.

Herein, the load information of the combustion device may be information directly related to the load of the combustion device or may be information related to the load (e.g., the load of a steam turbine driven by steam generated by a boiler as the combustion device, or the load of a generator driven by the steam turbine) which indirectly indicates the load of the combustion device.

The coal (raw material coal) is supplied onto the table of the coal pulverizing apparatus. With rotation of the table, the coal on the table moves toward the outer periphery of the table and is pulverized with the roller. Pulverized coal particles obtained by pulverizing in the roller move toward the rotary classifier along with the air flow from the air supply part. In the rotary classifier, the pulverized coal particles are classified so that only fine particles of the pulverized coal particles pass through the rotary classifier and flow out of the coal pulverizing apparatus. In this way, various processes need to be followed inside the coal pulverizing apparatus, during a period between supply of the raw material coal and discharge of the coal.

Accordingly, there is a time lag (coal output delay) until the change of the supply amount of the raw material coal to the coal pulverizing apparatus leads to the change of the coal discharge amount from the coal pulverizing apparatus.

The coal output delay can be separated into: response delay in an upstream process between supply of the raw material coal to the table of the coal pulverizing apparatus and arrival of the pulverized coal to the inlet of the rotary classifier; and response delay in a downstream process between passage of the pulverized coal through the rotary classifier and discharge of the coal from the coal pulverizing apparatus.

In the above configuration (1), in the first command value generation part, the command value of the first parameter is determined based on the first preceding signal determined in accordance with the load information of the combustion device.

This enables preceding change of the first parameter including at least one of the rotational speed of the table, the pressing force of the roller, or the air supply amount, in accordance with the load change of the combustion device, thus improving response delay in the upstream process between supply of the raw material coal to the table and arrival of the pulverized coal to the inlet of the rotary classifier.

On the other hand, in the second command value generation part, the command value of the second parameter is determined based on the second preceding signal determined in accordance with the load information of the combustion device. This enables preceding change of the second parameter including the rotational speed of the rotary classifier in accordance with the load change of the combustion device, thus improving response delay in the downstream process between passage of the pulverized coal through the rotary classifier and discharge of the coal from the coal pulverizing apparatus.

Thus, it is possible to improve both response delay in the upstream process and response delay in the downstream process, and it is possible to effectively reduce the coal output delay in the coal pulverizing apparatus as a whole.

When only the rotational speed of the rotary classifier, which is the second parameter, is adjusted by preceding control to rapidly change the coal discharge amount from the coal pulverizing apparatus, the classifying accuracy can decrease in the rotary classifier.

In this regard, in the above configuration (1), since preceding control is performed on not only the second parameter but also the first parameter, it is possible to improve the coal output delay while suppressing a reduction in classifying accuracy of the rotary classifier.

(2) In some embodiments, in the above configuration (1), the first command value generation part is configured to determine the first preceding signal, based on a change rate of the command value of the second parameter.

In the above configuration (2), since the first preceding signal is determined based on the change rate of the command value of the second parameter, it is possible to appropriately set the first control signal so as to achieve both the classifying accuracy and the improvement in coal output delay.

For instance, in a case where the change rate of the command value of the second parameter (rotational speed of the rotary classifier), which can affect the classifying accuracy, is large, the first preceding signal may be set to be a relatively large value, taken into consideration this condition. This makes it possible to achieve both the classifying accuracy and the improvement in coal output delay.

(3) In some embodiments, in the above configuration (2), the first command value generation part is configured to determine the first preceding signal so that a change rate of the first preceding signal is equal to or below a first rate limit determined based on the change rate of the command value of the second parameter.

In the above configuration (3), the first rate limit to limit the change rate of the first preceding signal is variable based on the change rate of the command value of the second parameter (rotational speed of the rotary classifier). Accordingly, it is possible to appropriately determine the first preceding signal, in accordance with the change rate of the command value of the second parameter (rotational speed of the rotary classifier) which can affect the classifying accuracy, and it is possible to achieve both the classifying accuracy and the improvement in coal output delay.

(4) In some embodiments, in any one of the above configurations (1) to (3), the second command value generation part is configured to determine the second preceding signal, based on a change rate of the command value of the first parameter.

In the above configuration (4), since the second preceding signal is determined based on the change rate of the command value of the first parameter, it is possible to appropriately set the second control signal so as to achieve both the classifying accuracy and the improvement in coal output delay.

For instance, in a case where the coal output delay is not sufficiently improved by preceding control of the first parameter, the second preceding signal may be determined taking into consideration this condition to sufficiently obtain achieve the effect of improving the coal output delay.

(5) In some embodiments, in the above configuration (4), the second command value generation part is configured to determine the second preceding signal so that a change rate of the second preceding signal is equal to or below a second rate limit determined based on the change rate of the command value of the first parameter.

In the above configuration (5), the second rate limit to limit the change rate of the second preceding signal is variable based on the change rate of the command value of the first parameter. Accordingly, even if the change rate of the command value of the first parameter is small and the coal output delay is not sufficiently improved by preceding control of the first parameter, an appropriate adjustment of the second rate limit effectively increases the coal output delay improvement effect owing to preceding control of the second parameter. Thus, it is possible to sufficiently control the coal output delay in the coal pulverizing apparatus as a whole.

(6) In some embodiments, in any one of the above configurations (1) to (5), the combustion device is a boiler for generating steam to be supplied to a steam turbine to drive a generator, and the load information of the combustion device includes at least one of a load, a load change rate, or a load change range of the generator.

In the above configuration (6), the first preceding signal and the second preceding signal are determined based on the load information such as the load, the load change rate, or the load change range of the generator, in the way as described in the above (1). Thus, it is possible to improve both response delay in the upstream process and response delay in the downstream process and thereby effectively improve the coal output delay, and it is possible to appropriately control the coal pulverizing apparatus in response to the load change of the generator. Furthermore, since preceding control is performed on not only the second parameter but also the first parameter, it is possible to improve the coal output delay in the coal pulverizing apparatus while suppressing a reduction in classifying accuracy of the rotary classifier.

(7) In some embodiments, in any one of the above configurations (1) to (6), the first command value generation part is configured to determine the first preceding signal in accordance with the load information and raw-material-coal characteristic information related to a characteristic of a raw material coal.

The coal output delay improvement effect with respect to a manipulated value of the first parameter is not the same when the raw material coal has a different characteristic.

In this regard, in the above configuration (7), since the first preceding signal is set taking into consideration not only the load information but also the raw-material-coal characteristic information, it is possible to appropriately perform preceding control of the first parameter in accordance with the characteristic of the raw material coal, and it is possible to effectively improve the coal output delay.

(8) In some embodiments, in any one of the above configurations (1) to (7), the second command value generation part is configured to determine the second preceding signal in accordance with the load information and raw-material-coal characteristic information related to a characteristic of a raw material coal.

The coal output delay improvement effect with respect to a manipulated value of the second parameter is not the same when the raw material coal has a different characteristic.

In this regard, in the above configuration (8), since the second preceding signal is set taking into consideration not only the load information but also the raw-material-coal characteristic information, it is possible to appropriately perform preceding control of the second parameter in accordance with the characteristic of the raw material coal, and it is possible to effectively improve the coal output delay.

(9) In some embodiments, in the above configuration (7) or (8), the raw-material-coal characteristic information includes a water content of the raw material coal.

According to findings by the present inventors, the water content of the raw material coal significantly affects the coal output delay improvement effect with respect to a manipulated value of each parameter.

In this regard, in the above configuration (9), since the water content of the raw material coal is used as the raw-material-coal characteristic information, it is possible to appropriately perform preceding control of the first parameter or the second parameter in accordance with the water content of the raw material coal, and it is possible to effectively improve the coal output delay.

(10) A coal pulverizing apparatus according to at least some embodiments of the present invention comprises: a rotatable table; a roller configured to pulverize a coal supplied from the table; an actuator configured to press the roller to the table; a rotary classifier configured to classify a pulverized coal obtained by pulverizing the coal with the roller; an air supply part configured to generate an air flow for guiding the pulverized coal toward the rotary classifier; and the control device with any one of the above configurations (1) to (9), configured to control the rotary classifier and at least one of the table, the actuator, or the air supply part.

With the above configuration (10), it is possible to improve both response delay in the upstream process and response delay in the downstream process by preceding control of the first parameter in the first command value generation part and preceding control of the second parameter in the second command value generation as described in the above (1). Thereby, it is possible to effectively reduce the coal output delay in the coal pulverizing apparatus as a whole.

Furthermore, since preceding control is performed on not only the second parameter but also the first parameter, it is possible to improve the coal output delay while suppressing a reduction in classifying accuracy of the rotary classifier.

(11) A coal-fired power plant according to at least some embodiments of the present invention comprises: the coal pulverizing apparatus with the above configuration (10); a boiler configured to burn the pulverized coal from the coal pulverizing apparatus to generate steam; a steam turbine configured to be driven by the steam generated from the boiler; and a generator configured to be driven by the steam turbine.

With the above configuration (11), it is possible to improve both response delay in the upstream process and response delay in the downstream process by preceding control of the first parameter in the first command value generation part and preceding control of the second parameter in the second command value generation as described in the above (1). Thereby, it is possible to effectively reduce the coal output delay in the coal pulverizing apparatus as a whole, and it is possible to rapidly change the load of the coal-fired power plant.

Furthermore, since preceding control is performed on not only the second parameter but also the first parameter, it is possible to improve the coal output delay while suppressing a reduction in classifying accuracy of the rotary classifier.

(12) A control method for a coal pulverizing apparatus according to at least some embodiments of the present invention is used for a coal pulverizing apparatus including a rotatable table, a roller configured to pulverize a coal supplied from the table, a rotary classifier configured to classify a pulverized coal obtained by pulverizing the coal with the roller, and an air supply part configured to generate an air flow for guiding the pulverized coal toward the rotary classifier, the control method comprising: a first command value generation step of generating a command value of a first parameter including at least one of a rotational speed of the table, a pressing force of the roller to the table, or an air supply amount in the air supply part; a second command value generation step of generating a command value of a second parameter including at least a rotational speed of the rotary classifier, the first command value generation step including determining the command value of the first parameter, based on a first preceding signal determined in accordance with at least load information of a combustion device which burns the pulverized coal from the coal pulverizing apparatus, the second command value generation step including determining the command value of the second parameter, based on a second preceding signal determined in accordance with at least the load information.

With the above method (12), it is possible to improve both response delay in the upstream process and response delay in the downstream process by preceding control of the first parameter and preceding control of the second parameter. Thereby, it is possible to effectively reduce the coal output delay in the coal pulverizing apparatus as a whole.

Furthermore, since preceding control is performed on not only the second parameter but also the first parameter, it is possible to improve the coal output delay while suppressing a reduction in classifying accuracy of the rotary classifier.

Advantageous Effects

According to at least one embodiment of the present invention, it is possible to improve the coal output delay in the coal pulverizing apparatus while suppressing a reduction in classifying accuracy of the rotary classifier.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
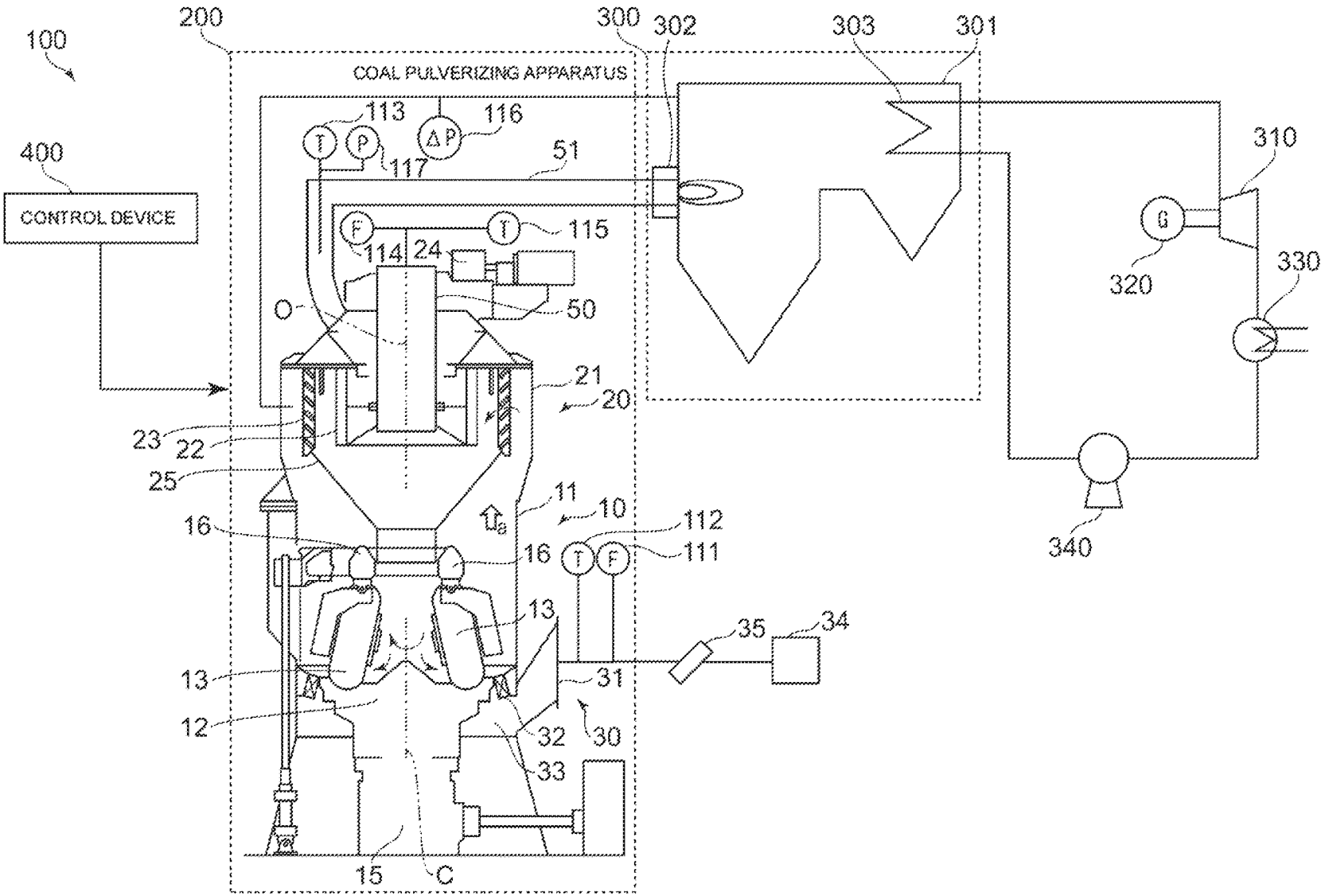
FIG. 1 is a schematic configuration diagram of a coal-fired power plant according to an embodiment.

FIG. 1 is a schematic configuration diagram of a coal-fired power plant according to an embodiment.

As shown in FIG. 1, the coal-fired power plant 100 according to an embodiment includes a coal pulverizing apparatus 200, a combustion device (boiler) 300, and a control device 400.

The coal pulverizing apparatus 200 includes a pulverizer 10 configured to pulverize coal (raw material coal), a rotary classifier 20 configured to classify fine particles of pulverized coal obtained by pulverizing the coal with the pulverizer 10, and an air supply part 30 configured to generate an air flow which guides the pulverized coal from the pulverizer 10 toward the rotary classifier 20.

In the illustrative embodiment shown in FIG. 1, the coal pulverizing apparatus 200 is a vertical pulverizing-and-classifying apparatus in which the rotary classifier 20 is disposed above the pulverizer 10 and the air supply part 30 is disposed around the pulverizer 10. In this case, an upper end of a pulverizer housing 11 of the pulverizer 10 is connected to a lower end of a classifier housing 21 of the rotary classifier 20 so as to integrally form a housing of the entire coal pulverizing apparatus 200.

In some embodiments, as shown in FIG. 1, the coal pulverizing apparatus 200 includes a supply tube 50 for supplying the coal (raw material coal) and a discharge tube 51 for discharging fine particles of the pulverized and classified coal to a furnace 301 of the combustion device 300 described later. The supply tube 50 is disposed at an upper portion of the coal pulverizing apparatus 200 and configured so that the raw material coal supplied from above the coal pulverizing apparatus 200 drops to a table 12 of the pulverizer 10 described later. The discharge tube 51 is disposed at an upper portion of the coal pulverizing apparatus 200 and configured to discharge the pulverized coal particles having passed through the rotary classifier 20 toward the furnace 301.

The pulverizer 10 of the coal pulverizing apparatus 200 includes, as shown in FIG. 1, a rotatable table 12 and a roller 13 configured to press the raw material coal to the table 12 to pulverize the raw material coal.

The table 12 is driven by a table driving part 15 disposed below the table 12 and thereby rotates around a central axis C of the table 12. The table driving part 15 may include a motor whose rotational speed is variably controlled in accordance with a table rotational speed command from the control device 400.

On the other hand, the roller 13 is configured to rotate on the table 12 rotationally driven by the table driving part 15 while being pressed toward the table 12 by an actuator 16. The actuator 16 may be for instance a hydraulic cylinder, and the pressing force of the roller 13 to the table 12 may be variably controlled in accordance with a roller pressing force command from the control device 400. The roller 13 may include a plurality of rollers (e.g., three rollers) disposed in a radially outer region of the table 12 at an interval in a circumferential direction of the table 12.

In the pulverizer 10 with the above configuration, the raw material coal drops from the supply tube 50 disposed above the table 12 to a radially inner region of the table 12 and then moves toward the outer periphery of the table 12 by a centrifugal force of the table 12, so that the raw material coal is supplied to a gap between the table 12 and the roller 13. Since the roller 13 is pressed toward the table 12 by the actuator 16, the raw material coal supplied to the gap between the table 12 and the roller 13 is pulverized. Consequently, the pulverized coal is obtained.

The air supply part 30 includes an air intake port 31 provided in the pulverizer housing 11, an air chamber 33 which is an annular space located below the table 12 so as to communicate with the air intake port 31, a fan 34 for supplying air to the air chamber 33 via the air intake port 31, and an air discharge port 32 configured to discharge an air flow upward from the air chamber 33.

The air discharge port 32 may be a flow path formed between throat vanes arranged in a circumferential direction at a distance on a radially outer side of the table 12.

The air supply part 30 may further include a damper 35 for adjusting the air supply amount from the fan 34. In this case, the opening degree of the damper 35 may be controlled so that the air supply amount in the air supply part 30 is adjusted in accordance with an air supply amount command from the control device 400.

The air supply part 30 with the above configuration allows air taken from the air discharge port 32 into the air chamber 33 to be discharged upward via the air discharge port 32, consequently forming an upward air flow (see arrow "a" in FIG. 1) inside the housing (11, 21) of the coal pulverizing apparatus 200.

In this context, particles having a large particle size deviate from the air flow "a" due to gravity, drop downward and return to the table 12, and are pulverized again.

The rotary classifier 20 is disposed above the pulverizer 10 and configured to classify the pulverized coal particles accompanying the air flow "a" formed by the air supply part 30.

In some embodiments, as shown in FIG. 1, the rotary classifier 20 includes an annular rotational portion 22 for classifying the pulverized coal particles. The annular rotational portion 22 is rotatably provided around a rotational axis O along a vertical direction in an inner space of the classifier housing 21. The annular rotational portion 22 includes a plurality of rotary fins arranged in a circumferential direction at a distance and allowing the pulverized coal particles to pass through a gap between adjacent rotary fins.

The pulverized coal is classified in the annular rotational portion 22 according to the following principle.

The rotation of the annular rotational portion 22 imparts rotation to the pulverized coal flowing toward the rotary classifier 20 accompanying the air flow "a". As a result, a centrifugal force directed radially outward due to the centrifugal field formed by the annular rotational portion 22, as well as a drag due to the velocity component of the air flow directed radially inward, are applied to the pulverized coal particles accompanying the air flow. A particle size with equilibrium of the centrifugal force and the drag is called a theoretical classification size. Coarse particles having a greater particle size than the theoretical classification size have a stronger centrifugal force than a drag caused by the velocity component of the air flow and are thrown outside the annular rotational portion 22. On the other hand, fine particles having a smaller particle size than the theoretical classification size are subjected to a stronger drag from the air flow than the centrifugal force and thus pass through the annular rotational portion 22 along with the air flow. In this way, in the annular rotational portion 22, the pulverized coal particles conveyed by the air flow are classified into coarse particles and fine particles.

In some embodiments, the rotary classifier 20 includes a classifier driving part 24 for rotating the annular rotational portion 22 around the rotational axis O.

The classifier driving part 24 may include a motor whose rotational speed is variably controlled in accordance with a classifier rotational speed command from the control device 400.

As shown in FIG. 1, the rotary classifier 20 may include an annular stationary portion 23 disposed on a radially outer side of the annular rotational portion 22, inside the classifier housing 21. The annular stationary portion 23 has a plurality of stationary fins arranged in a height direction at a distance and allowing the air flow "a" to pass through a gap between adjacent stationary fins. The annular stationary portion 23 is configured to guide the air flow "a" flowing from the radially outer side.

Further, as shown in FIG. 1, the rotary classifier 20 may further include a hopper 25 disposed below the annular rotational portion 22 and configured to recover the coarse particles which have not pass through the annular rotational portion 22 to the table 12 of the pulverizer 10.

The pulverized coal produced in the coal pulverizing apparatus 200 with the above configuration is supplied to the combustion device 300.

The combustion device (boiler) 300 includes a furnace 301 for burning the fine particles of coal discharged from the coal pulverizing apparatus 200 with a burner 302 to produce a combustion gas. A heat exchanger 303 is disposed inside the furnace 301. In the heat exchanger 303, steam is generated by heat exchange with the combustion gas inside the furnace 301.

The steam generated by the combustion device (boiler) 300 is supplied to a steam turbine 310 of the coal-fired power plant 100. The steam turbine 310 is driven by the steam supplied from the combustion device (boiler) 300. To a rotational shaft of the steam turbine 310, a shaft of a generator 320 is connected, so that the generator 320 is driven by the steam turbine 310 to generate electric power.

The steam discharged from the steam turbine 310 is recovered by a condenser 330. Condensed water obtained by the condenser 330 is supplied to the heat exchanger 303 again through a water supply pump 340.

In the coal-fired power plant 100 with the above configuration, the control device 400 controls each part of the coal pulverizing apparatus 200, such as the table driving part 15, the actuator 16, the damper 35, and the classifier driving part 24.

The coal pulverizing apparatus 200 includes some measurement tools to check the state of the coal pulverizing apparatus 200, for instance, including at least one of an inlet air flow rate meter 111, an inlet air thermometer 112, an outlet air thermometer 113, a coal supply amount meter 114, a coal supply thermometer 115, a furnace differential pressure gauge 116, or an outlet pressure gauge 117. Further, a wattmeter (not shown) is disposed to measure the output power of the generator 320. Load information (e.g., load change range, load change rate, load) of the combustion device 300 (coal-fired power plant 100) can be thus acquired.

In this case, measurement results of these various tools may be sent to the control device 400 and used for controlling each part of the coal pulverizing apparatus 200 by the control device 400.

Next, with reference to FIGS. 2 to 4, the control device 400 will be described in detail.

Figure 2:
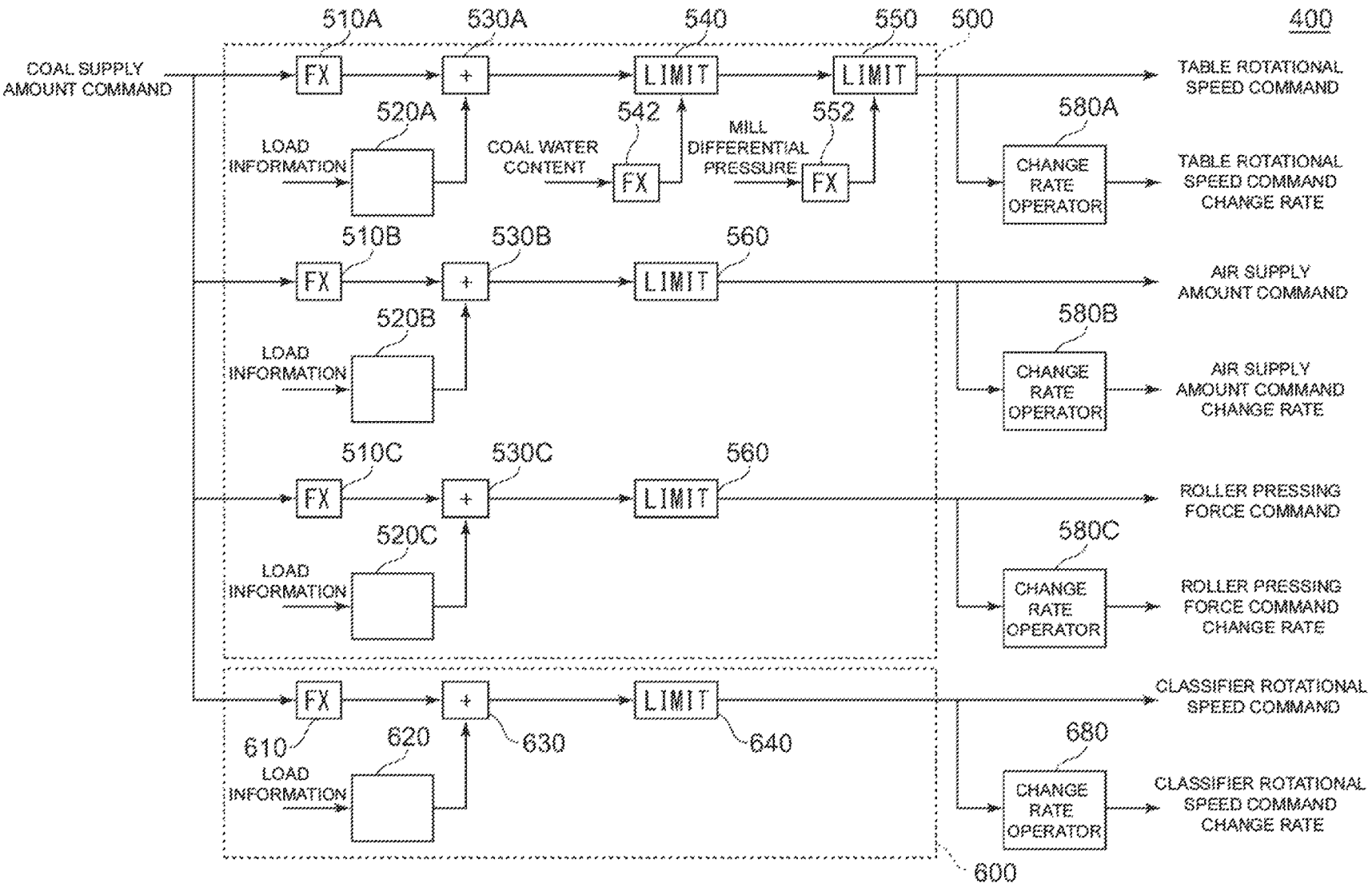
FIG. 2 is a block configuration diagram of a control device according to an embodiment.

FIG. 2 is a block configuration diagram of the control device according to an embodiment. FIG. 3 is a block configuration diagram of a first preceding signal operation part 520A of the control device 400. FIG. 4 is a block configuration diagram of a second preceding signal operation part 620 of the control device 400.

In some embodiments, the control device 400 includes a first command value generation part 500 for generating a command value of a first parameter including at least one of the rotational speed of the table 12, the pressing force of the roller 13 to the table 12, or the air supply amount in the air supply part 30, and a second command value generation part 600 for generating a command value of a second parameter including at least the rotational speed of the rotary classifier 20.

In the illustrative embodiment shown in FIG. 2, the first command value generation part 500 is configured to generate a command value of each of three first parameters including the rotational speed of the table 12, the pressing force of the roller 13 to the table 12, and the air supply amount in the air supply part 30. In another embodiment, the first command value generation part 500 is configured to generate a command value of only a part of the three first parameters.

In some embodiments, as shown in FIG. 2, the first command value generation part 500 includes a basic command value calculation part 510 (510A to 510C) for calculating a basic command value of the first parameter in accordance with a coal supply amount command, which sets the amount of coal supplied to the coal pulverizing apparatus 200, and a first preceding signal operation part 520 (520A to 520C) for calculating a first preceding signal determined in accordance with the load information of the combustion device 300. The basic command value calculation part 510 (510A to 510C) may include a function which increases the basic command value of the first parameter with an increase in the coal supply amount command. The coal supply amount command may be determined based on the load of the combustion device 300 (=the load of the generator 320).

In the illustrative embodiment shown in FIG. 2, an adder 530 (530A to 530C) calculates the sum of the basic command value of the first parameter obtained by the basic command value calculation part 510 (510A to 510C) and the first preceding signal obtained by the first preceding signal operation part 520 (520A to 520C), and the command value of the first parameter is generated based on an output signal from the adder 530.

As shown in FIG. 2, the output signal from the adder 530 (530A) may be subjected to limit processing by a first limit (upper limit) 540 and a second limit (lower limit) 550 to limit the command value of the first parameter within a desired range.

In this case, the first limit 540 may limit the command value of the first parameter to be equal to or below an upper limit value, based on an output signal from a function 542 configured to variably set the upper limit value of the command value of the first parameter, in accordance with the water content of the raw material coal. The water content of the raw material coal may be calculated through estimation based on measurement results of the aforementioned various measurement tools (111 to 117).

Similarly, the second limit 550 may limit the command value of the first parameter to be equal to or higher than a lower limit value, based on an output signal from a function 552 configured to variably set the lower limit value of the command value of the first parameter, in accordance with the mill differential pressure (differential pressure between upstream and downstream of the coal pulverizing apparatus 200).

Although in the example shown in FIG. 2, limit processing by the first limit 540 and the second limit 550 is performed only on the table rotational speed command, in other embodiments, limit processing by the first limit 540 and the second limit 550 may also be performed on other first parameters (air supply amount command or roller pressing force command).

Additionally, as shown in FIG. 2, a limit 560 may be provided to limit the command value of the first parameter within a range specified by a fixed upper limit value and a fixed lower limit value. The limit 560 is configured to perform limit processing on the output signal from the adder 530 (530B, 530C) to limit the command value of the first parameter within the specified range.

Although in the illustrative embodiment shown in FIG. 2, limit processing by the limit 560 is applied only to the air supply amount command and the roller pressing force command, in other embodiments, limit processing by the limit 560 may also be performed on the table rotational speed command, instead of the first limit 540 and the second limit 550.

Further, as shown in FIG. 2, the control device 400 may include a change rate operator 580 (580A to 580C) for calculating the change rate (change speed) of the command value of the first parameter generated by the first command value generation part 500. The change rate of the command value of the first parameter obtained by the change rate operator 580 may be used for calculating a second preceding signal in a second preceding signal operation part 620 described later (see input signals to functions 880, 882, 884 in FIG. 4).

Figure 3:
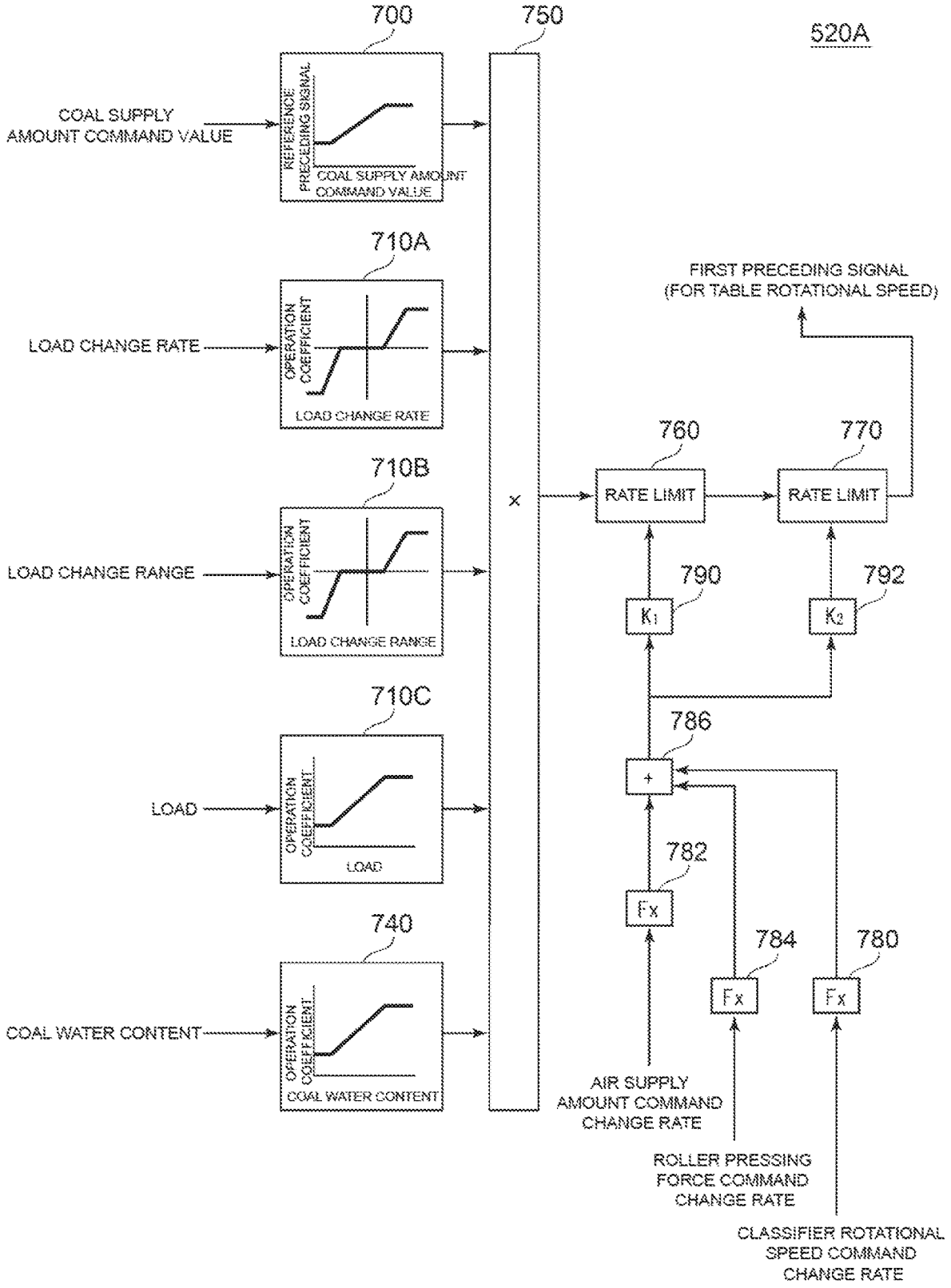
FIG. 3 is a block configuration diagram of a first preceding signal operation part according to an embodiment.

As shown in FIG. 3, the first preceding signal operation part 520 (520A) of the first command value generation part 500 is configured to determine the first preceding signal, in accordance with the load information of the combustion device 300 (or the coal-fired power plant 100 including the same).

Although FIG. 3 shows a configuration of the first preceding signal operation part 520A for obtaining the first preceding signal used for calculating the command value of the table rotational speed, which is an example of the first parameter, first preceding signals for other first parameters (air supply amount or roller pressing force) may also be calculated by first preceding signal operation parts (520B, 520C) having the same configuration as the first preceding signal operation part 520A shown in FIG. 3.

More specifically, the first preceding signal operation part 520 (520A) may include a first reference preceding signal calculation part 700 for obtaining a reference value (first reference preceding signal) of the first preceding signal, based on the coal supply amount command value, and an operation coefficient calculation part 710 (710A to 710C) for obtaining an operation coefficient (correction coefficient) by which the first reference preceding signal is multiplied, in accordance with the load information of the combustion device 300 (coal-fired power plant 100).

The first reference preceding signal calculated in the first reference preceding signal calculation part 700 and the operation coefficient calculated in the operation coefficient calculation part 710 (710A to 710C) are input into a multiplier 750 and multiplied together, so that the first preceding signal is determined based on the product calculated by the multiplier 750.

The first reference preceding signal calculation part 700 may include a function which increases the first reference preceding signal with an increase in the coal supply amount command.

On the other hand, the load information considered when the operation coefficient calculation part 710 (710A to 710C) calculates the operation coefficient may be at least one of the load, the load change rate, or the load change range of the combustion device 300. In this case, the operation coefficient calculation part 710 (710A to 710C) may include a function which increases the operation coefficient with an increase in the load information such as the load, the load change rate, or the load change range of the combustion device 300.

In some embodiments, as shown in FIG. 3, the first preceding signal operation part 520 (520A) is configured to calculate the first preceding signal, based on raw-material-coal characteristic information related to the characteristic of the raw material coal, in addition to the load information.

In the illustrative embodiment shown in FIG. 3, the first preceding signal operation part 520 (520A) further include an operation coefficient calculation part 740 for calculating an operation coefficient in accordance with the water content of the raw material coal, which is an example of the raw-material-coal characteristic information. The operation coefficient obtained by the operation coefficient calculation part 740 is input to the multiplier 750. Thus, since the first preceding signal is set taking into consideration not only the load information but also the raw-material-coal characteristic information, it is possible to appropriately perform preceding control of the first parameter in accordance with the characteristic of the raw material coal, and it is possible to effectively improve the coal output delay.

In some embodiments, as shown in FIG. 3, the first preceding signal operation part 520 (520A) is configured to determine the first preceding signal, based on the change rate of the command value of the second parameter.

In the illustrative embodiment shown in FIG. 3, the first preceding signal operation part 520 (520A) includes rate limits (760, 770) for limiting the change rate of the first preceding signal to be equal to or below a threshold (=first rate limit) determined based on the change rate of the command value of the second parameter (=classifier rotational speed command change rate). The rate limit 760 is adapted to limit a positive change rate (=increase rate) of the first preceding signal to be equal to or below a threshold. On the other hand, the rate limit 770 is adapted to limit a negative change rate (=decrease rate) of the first preceding signal to be equal to or below a threshold.

Thus, the rate limits (760, 770) limit the change rate of the first preceding signal equal to or below a threshold which is variable depending on the change rate of the command value of the second parameter (=classifier rotational speed command change rate). Accordingly, it is possible to appropriately determine the first preceding signal, in accordance with the change rate of the command value of the second parameter (rotational speed of the rotary classifier 20) which can affect the classifying accuracy, and it is possible to achieve both the classifying accuracy and the improvement in coal output delay.

In the example shown in FIG. 3, the first preceding signal operation part 520 (520A) includes a function 780 which outputs a value in accordance with the change rate of the command value of the second parameter (=classifier rotational speed command change rate) and a function (782, 784) which outputs a value in accordance with the change rate of the first parameter (in case of the example in FIG. 3, air supply amount command change rate and roller pressing force command change rate) other than the first parameter (in case of the example in FIG. 3, table rotational speed) related to an operand in the first preceding signal operation part 520 (520A). The adder 786 provides the sum of respective outputs from the functions (780, 782, 784). The operation result of the adder 786 is multiplied by gain $K_1$, $K_2$ to obtain the threshold used for limit processing in each rate limit (760, 770).

Referring to FIG. 2 again, the second command value generation part 600 will be described.

In some embodiments, as shown in FIG. 2, the second command value generation part 600 includes a basic command value calculation part 610 for calculating a basic command value of the second parameter in accordance with the coal supply amount command, and a second preceding signal operation part 620 for calculating a second preceding signal determined in accordance with the load information of the combustion device 300. The basic command value calculation part 610 may include a function which increases the basic command value of the second parameter with an increase in the coal supply amount command.

In the illustrative embodiment shown in FIG. 2, an adder 630 calculates the sum of the basic command value of the second parameter obtained by the basic command value calculation part 610 and the second preceding signal obtained by the second preceding signal operation part 620, and the command value of the second parameter is generated based on an output signal from the adder 630.

Additionally, in the illustrative embodiment shown in FIG. 2, a limit 640 may be provided to limit the command value of the second parameter within a range specified by a fixed upper limit value and a fixed lower limit value. The limit 640 is configured to perform limit processing on the output signal from the adder 630 to limit the command value of the second parameter within the specified range.

In other embodiments, the output signal from the adder 630 may be subjected to limit processing by a similar configuration to the first limit (upper limit) 540 and the second limit (lower limit) 550 as shown in FIG. 2, instead of the limit 640, to limit the command value of the second parameter within a desired range. In this case, the first limit 540 may limit the command value of the second parameter to be equal to or below an upper limit value, based on an output signal from a function 542 configured to variably set the upper limit value of the command value of the second parameter, in accordance with the water content of the raw material coal. Similarly, the second limit 550 may limit the command value of the second parameter to be equal to or higher than a lower limit value, based on an output signal from a function 552 configured to variably set the lower limit value of the command value of the second parameter, in accordance with the mill differential pressure (differential pressure between upstream and downstream of the coal pulverizing apparatus 200).

Further, as shown in FIG. 2, the control device 400 may include a change rate operator 680 for calculating the change rate (change speed) of the command value of the second parameter generated by the second command value generation part 600.

The change rate of the command value of the second parameter obtained by the change rate operator 680 may be used for calculating the first preceding signal in the first preceding signal operation part 520 as described above (see an input signal to the function 780 in FIG. 3).

Figure 4:
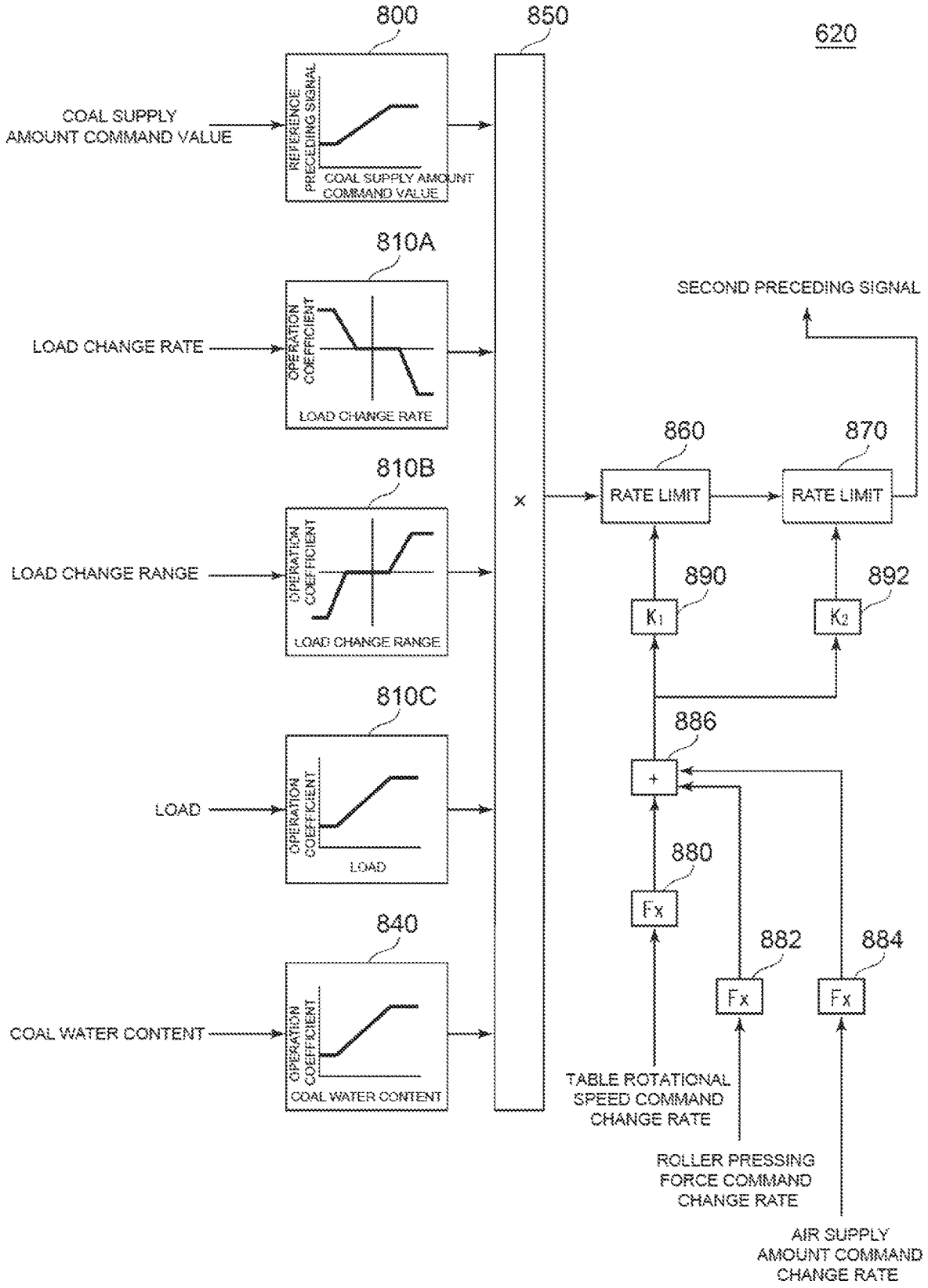
FIG. 4 is a block configuration diagram of a second preceding signal operation part according to an embodiment.

As shown in FIG. 4, the second preceding signal operation part 620 of the second command value generation part 600 is configured to determine the second preceding signal, in accordance with the load information of the combustion device 300 (or the coal-fired power plant 100 including the same).

More specifically, the second preceding signal operation part 620 may include a second reference preceding signal calculation part 800 for obtaining a reference value (second reference preceding signal) of the second preceding signal, based on the coal supply amount command value, and an operation coefficient calculation part 810 (810A to 810C) for obtaining an operation coefficient (correction coefficient) by which the second reference preceding signal is multiplied, in accordance with the load information of the combustion device 300 (coal-fired power plant 100).

The second reference preceding signal calculated in the second reference preceding signal calculation part 800 and the operation coefficient calculated in the operation coefficient calculation part 810 (810A to 810C) are input into a multiplier 850 and multiplied together, so that the second preceding signal is determined based on a product calculated by the multiplier 850.

The second reference preceding signal calculation part 800 may include a function which increases the second reference preceding signal with an increase in the coal supply amount command.

On the other hand, the load information considered when the operation coefficient calculation part 810 (810A to 810C) calculates the operation coefficient may be at least one of the load, the load change rate, or the load change range of the combustion device 300. In this case, when the load information is the load change rate of the combustion device 300, the operation coefficient calculation part 810A may include a function which decreases the operation coefficient with an increase in the load change rate of the combustion device 300. By contrast, when the load information is the load change range or the load of the combustion device 300, the operation coefficient calculation part 810 (810A to 810C) may include a function which increases the operation coefficient with an increase in the load change rate of the combustion device 300.

In some embodiments, as shown in FIG. 4, the second preceding signal operation part 620 is configured to calculate the second preceding signal, based on raw-material-coal characteristic information related to the characteristic of the raw material coal, in addition to the load information.

In the illustrative embodiment shown in FIG. 4, the second preceding signal operation part 620 further include an operation coefficient calculation part 840 for calculating the operation coefficient in accordance with the water content of the raw material coal, which is an example of the raw-material-coal characteristic information. The operation coefficient obtained by the operation coefficient calculation part 840 is input to the multiplier 850. Thus, since the second preceding signal is set taking into consideration not only the load information but also the raw-material-coal characteristic information, it is possible to appropriately perform preceding control of the second parameter in accordance with the characteristic of the raw material coal, and it is possible to effectively improve the coal output delay.

In some embodiments, as shown in FIG. 4, the second preceding signal operation part 620 is configured to determine the second preceding signal, based on the change rate of the command value of the first parameter.

In the illustrative embodiment shown in FIG. 4, the second preceding signal operation part 620 includes rate limits (860, 870) for limiting the change rate of the second preceding signal to be equal to or below a threshold (=second rate limit) determined based on the change rate of the command value of the first parameter (=table rotational speed command change rate, roller pressing force command change rate, air supply amount command change rate). The rate limit 860 is adapted to limit a positive change rate (=increase rate) of the second preceding signal to be equal to or below a threshold. On the other hand, the rate limit 870 is adapted to limit a negative change rate (=decrease rate) of the second preceding signal to be equal to or below a threshold.

Thus, the rate limits (860, 870) limit the change rate of the second preceding signal equal to or below a threshold which is variable depending on the change rate of the command value of the first parameter (=table rotational speed command change rate, roller pressing force command change rate, air supply amount command change rate). Accordingly, even if the change rate of the command value of the first parameter is small and the coal output delay is not sufficiently improved by preceding control of the first parameter, an appropriate adjustment of the second rate limit effectively increases the coal output delay improvement effect owing to preceding control of the second parameter. Thus, it is possible to sufficiently control the coal output delay in the coal pulverizing apparatus 200 as a whole.

In the example shown in FIG. 4, the second preceding signal operation part 620 includes functions (880, 882, 884) which output values in accordance with the change rates of the command values of the first parameters (=table rotational speed command change rate, roller pressing force command change rate, air supply amount command change rate). The adder 886 provides the sum of respective outputs from the functions (880, 882, 884). The operation result of the adder 886 is multiplied by gain $K_1$, $K_2$ to obtain the threshold used for limit processing in each rate limit (860, 870).

According to some embodiments described above, in the first preceding signal operation part 520 (520A to 520C) of the first command value generation part 500, the first preceding signal is determined in accordance with the load information of the combustion device 300, and the command value of the first parameter is determined based on the first preceding signal. This enables preceding change of the first parameter including at least one of the rotational speed of the table 12, the pressing force of the roller 13, or the air supply amount in the air supply part 30, in accordance with the load change of the combustion device 300, thus improving response delay in the upstream process between supply of the raw material coal to the table 12 and arrival of the pulverized coal to the inlet of the rotary classifier 20.

On the other hand, in the second preceding signal operation part 620 of the second command value generation part 600, the command value of the second parameter is determined based on the second preceding signal determined in accordance with the load information of the combustion device 300. This enables preceding change of the second parameter including the rotational speed of the rotary classifier 20 in accordance with the load change of the combustion device 300, thus improving response delay in the downstream process between passage of the pulverized coal through the rotary classifier 20 and discharge of the coal from the coal pulverizing apparatus 200.

Thus, it is possible to improve both response delay in the upstream process and response delay in the downstream process, and it is possible to effectively reduce the coal output delay in the coal pulverizing apparatus 200 as a whole.

When only the rotational speed of the rotary classifier 20, which is the second parameter, is adjusted by preceding control to rapidly change the coal discharge amount from the coal pulverizing apparatus 200, the classifying accuracy can decrease in the rotary classifier 20.

In this regard, according to the above-described embodiment, since preceding control is performed on not only the second parameter but also the first parameter, it is possible to improve the coal output delay while suppressing a reduction in classifying accuracy of the rotary classifier 20.

Figure 5:
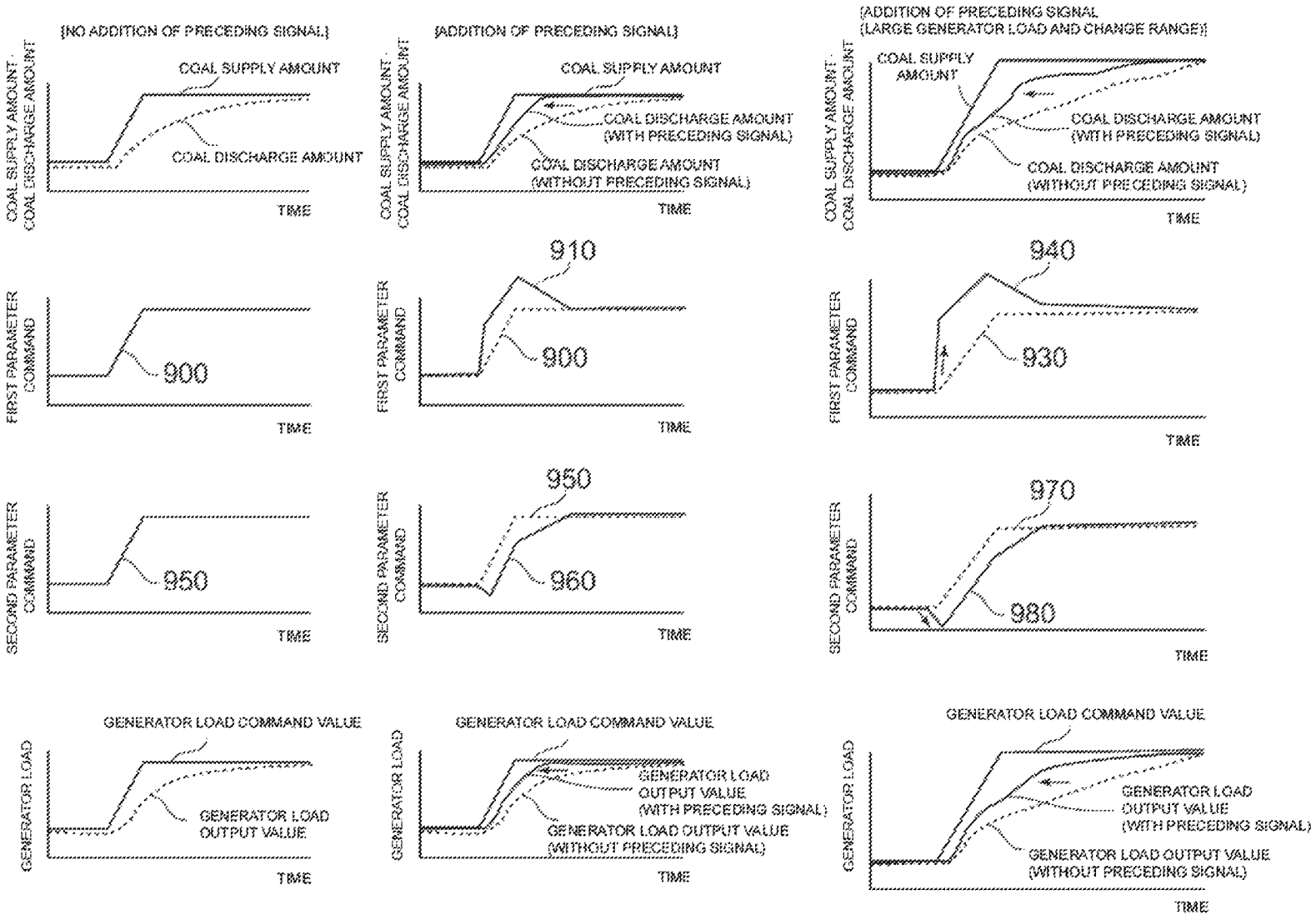
FIG. 5 is graphs showing the behavior of various parameters when the load of the coal-fired power plant is changed; (a) shows the change in the coal supply amount and coal discharge amount of the coal pulverizing apparatus; (b) shows the change in the command value of a first parameter; (c) shows the change in the command value of a second parameter; and (d) shows the change in the generator load.

FIG. 5 is graphs showing the behavior of various parameters when the load of the coal-fired power plant 100 is changed; FIG. 5(*a*) shows the change in the coal supply amount and coal discharge amount of the coal pulverizing apparatus 200; FIG. 5(*b*) shows the change in the command value of the first parameter; FIG. 5(*c*) shows the change in the command value of the second parameter; and FIG. 5(*d*) shows the change in the load of the generator 320.

In each of FIGS. 5(*a*) to 5(*d*), temporal change of the parameters when preceding control by the first preceding signal and the second preceding signal is not performed is shown on the left side; temporal change of the parameters when preceding control by the first preceding signal and the second preceding signal is performed is shown in the middle; temporal change of the parameters when the load change range is large is shown on the right side.

As shown in FIGS. 5(*b*) and 5(*c*), in the case where preceding control by the first preceding signal and the second preceding signal is not performed, the command values of the first parameter and the second parameter themselves are respectively the basic command values (900, 950) calculated in accordance with the coal supply amount command in the basic command value calculation parts (510, 610) shown in FIG. 2.

Consequently, as shown in FIG. 5(*a*), even if the coal supply amount to the coal pulverizing apparatus 200 is increased with an increase in the load command value of the generator 320, the coal discharge amount from the coal pulverizing apparatus 200 is only gently increased. The reason is that even if the command value of the first parameter (=table rotational speed command, roller pressing force command, air supply amount command) and the command value of the second parameter (=classifier rotational speed command) are changed with the increase in the coal supply amount, the coal discharge amount from the coal pulverizing apparatus 200 does not rapidly follow the change, due to the coal output delay. Thus, response delay occurs in the coal discharge amount from the coal pulverizing apparatus 200, which causes response delay of the load of the generator 320 in response to the load command value, as shown in FIG. 5(*d*).

By contrast, as described in the above embodiment, in the case where preceding control by the first preceding signal and the second preceding signal is performed, the first preceding signal and the second preceding signal determined in accordance with the load information are added to the basic command values (900, 950) to generate a command value 910 of the first parameter and a command value 960 of the second parameter.

Consequently, as shown in FIG. 5(*a*), when the coal supply amount to the coal pulverizing apparatus 200 is increased with an increase in the load command value of the generator 320, response delay (coal output delay) of the coal discharge amount from the coal pulverizing apparatus 200 is reduced. Thus, since response delay of the coal discharge amount from the coal pulverizing apparatus 200 is reduced, response delay of the load of the generator 320 in response to the load command value is also reduced, as shown in FIG. 5(*d*).

Similarly, in the case where the load change range is large, when preceding control by the first preceding signal and the second preceding signal are performed, the first preceding signal and the second preceding signal determined in accordance with the load information are added to the basic command values (930, 970) to generate a command value 940 of the first parameter and a command value 980 of the second parameter.

Consequently, as shown in FIG. 5(*a*), when the coal supply amount to the coal pulverizing apparatus 200 is increased with an increase in the load command value of the generator 320, response delay (coal output delay) of the coal discharge amount from the coal pulverizing apparatus 200 is reduced. Thus, since response delay of the coal discharge amount from the coal pulverizing apparatus 200 is reduced, response delay of the load of the generator 320 in response to the load command value is also reduced, as shown in FIG. 5(*d*).

Figure 6:
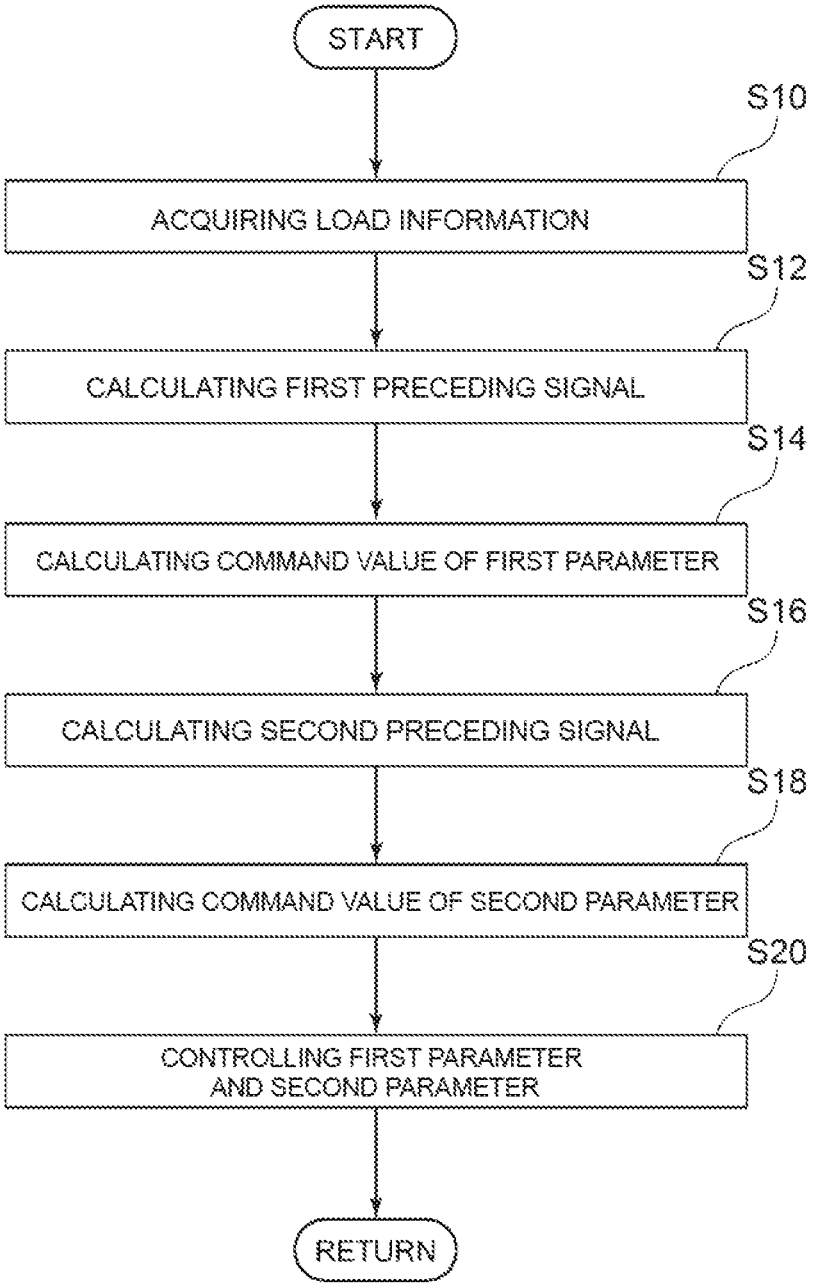
FIG. 6 is a flowchart of a method for controlling a coal pulverizing apparatus according to an embodiment.

Next, with reference to FIG. 6, a control method for the coal pulverizing apparatus 200 according to some embodiments will be described. FIG. 6 is a flowchart of the control method for the coal pulverizing apparatus 200 according to an embodiment.

As shown in FIG. 6, first, load information of the combustion device 300 (coal-fired power plant 100) is acquired (step S10). The load information may be at least one of the load, the load change rate, or the load change range of the combustion device 300.

Then, a first preceding signal used for calculating a command value of a first parameter is calculated in accordance with the load information of the combustion device 300 acquired in step S10 (step S12). The first parameter includes at least one of the rotational speed of the table 12, the pressing force of the roller 13 to the table 12, or the air supply amount in the air supply part 30, as described above.

The first preceding signal may be calculated using the first preceding signal operation part 520 shown in FIG. 3. In this case, a reference value of the first preceding signal (first reference preceding signal) may be obtained by the first reference preceding signal calculation part 700 in accordance with the coal supply amount command value, an operation coefficient (correction coefficient) may be obtained by the operation coefficient calculation part 710 (710A to 710C) in accordance with the load information of the combustion device 300 (coal-fired power plant 100), and the first preceding signal may be determined based on a product of the first reference preceding signal and the operation coefficient. In this operation, the first preceding signal may be determined taking into consideration raw-material-coal characteristic information related to the characteristic of the raw material coal, in addition to the load information of the combustion device 300. More specifically, an operation coefficient in accordance with the water content of the raw material coal, which is an example of the raw-material-coal characteristic information, may be calculated by the operation coefficient calculation part 740, and the first preceding signal may be determined based on a product of the first reference preceding signal, the operation coefficient obtained by the operation coefficient calculation part 710 (710A to 710C), and the operation coefficient obtained by the operation coefficient calculation part 740. Further, when the first preceding signal is determined in the first preceding signal operation part 520, the change rate of a command value of a second parameter may be taken into consideration. More specifically, the change rate of the first preceding signal may be limited by the rate limits (760, 770) to be equal to or below a threshold (=first rate limit) which is determined based on the change rate of the command value of the second parameter (=classifier rotational speed command change rate).

Then, a command value of the first parameter is generated based on the first preceding signal obtained in step S12 (step S14).

More specifically, a basic command value of the first parameter is calculated by the basic command value calculation part 510 (510A to 510C), in accordance with a coal supply amount command, which sets the amount of coal supplied to the coal pulverizing apparatus 200, and the first preceding signal obtained in step S12 is added to the basic command value to calculate the command value of the first parameter.

Further, a second preceding signal used for calculating the command value of the second parameter is calculated in accordance with the load information of the combustion device 300 acquired in step S10 (step S16). The second parameter includes the rotational speed of the rotary classifier 20, as described above.

The second preceding signal may be calculated using the second preceding signal operation part 620 shown in FIG. 4. In this case, a reference value of the second preceding signal (second reference preceding signal) may be obtained by the second reference preceding signal calculation part 800 in accordance with the coal supply amount command value, an operation coefficient (correction coefficient) may be obtained by the operation coefficient calculation part 810 (810A to 810C) in accordance with the load information of the combustion device 300 (coal-fired power plant 100), and the second preceding signal may be determined based on a product of the second reference preceding signal and the operation coefficient. In this operation, the second preceding signal may be determined taking into consideration raw-material-coal characteristic information related to the characteristic of the raw material coal, in addition to the load information of the combustion device 300. More specifically, an operation coefficient in accordance with the water content of the raw material coal, which is an example of the raw-material-coal characteristic information, may be calculated by the operation coefficient calculation part 840, and the second preceding signal may be determined based on a product of the second reference preceding signal, the operation coefficient obtained by the operation coefficient calculation part 810 (810A to 810C), and the operation coefficient obtained by the operation coefficient calculation part 840. Further, when the second preceding signal is determined in the second preceding signal operation part 620, the change rate of the command value of the first parameter may be taken into consideration. More specifically, the change rate of the second preceding signal may be limited by the rate limits (860, 870) to be equal to or below a threshold (=second rate limit) which is determined based on the change rate of the command value of the first parameter (=table rotational speed command change rate, roller pressing force command change rate, air supply amount command change rate).

Then, the command value of the second parameter is generated based on the second preceding signal obtained in step S16 (step S18).

More specifically, a basic command value of the second parameter is calculated by the basic command value calculation part 610, in accordance with the coal supply amount command, which sets the amount of coal supplied to the coal pulverizing apparatus 200, and the second preceding signal obtained in step S16 is added to the basic command value to calculate the command value of the second parameter.

Then, each part of the coal pulverizing apparatus 200 is controlled based on the command value of the first parameter obtained in step S14 and the command value of the second parameter obtained in step S18 (step S20).

More specifically, in accordance with the command value of the first parameter, at least one of the table driving part 15, the actuator 16, or the damper 35 of the coal pulverizing apparatus 200 is controlled. Similarly, in accordance with the command value of the second parameter, the classifier driving part 24 of the coal pulverizing apparatus 200 is controlled.

According to the method shown in FIG. 6, it is possible to improve both response delay in the upstream process and response delay in the downstream process by preceding control of the first parameter and preceding control of the second parameter. Thus, it is possible to reduce the coal output delay in the coal pulverizing apparatus 200 as a whole.

Furthermore, since preceding control is performed on not only the second parameter but also the first parameter, it is possible to improve the coal output delay in the coal pulverizing apparatus while suppressing a reduction in classifying accuracy of the rotary classifier 20.

Embodiments of the present invention were described in detail above, but the present invention is not limited thereto, and various amendments and modifications may be implemented.

REFERENCE SIGNS LIST

10 Pulverizer
11 Pulverizer housing
12 Table
13 Roller
15 Table driving part
16 Actuator
20 Rotary classifier
21 Classifier housing
22 Annular rotational portion
23 Annular stationary portion
24 Classifier driving part
25 Hopper
30 Air supply part
31 Air intake port
32 Air discharge port
33 Air chamber
34 Fan
35 Damper
50 Supply tube
51 Discharge tube
100 Coal-fired power plant
111 Inlet air flow rate meter
112 Inlet air thermometer
113 Outlet air thermometer
114 Coal supply amount meter
115 Coal supply thermometer
116 Furnace differential pressure gauge
117 Outlet pressure gauge
200 Coal pulverizing apparatus
300 Combustion device
301 Furnace
302 Burner
303 Heat exchanger
310 Steam turbine
320 Generator
330 Condenser
340 Water supply pump
400 Control device
500 First command value generation part
510 Basic command value calculation part
520 First preceding signal operation part
600 Second command value generation part
610 Basic command value calculation part
620 Second preceding signal operation part
700 First reference preceding signal calculation part

710 (710A to 710C) Operation coefficient calculation part
800 Second reference preceding signal calculation part
810 (810A to 810C) Operation coefficient calculation part

The invention claimed is:

1. A control device for a coal pulverizing apparatus, the coal pulverizing apparatus including a rotatable table, a roller configured to pulverize a coal supplied from the table, a rotary classifier configured to classify a pulverized coal obtained by pulverizing the coal with the roller, and an air supply part configured to generate an air flow for guiding the pulverized coal toward the rotary classifier, the control device comprising:

a first command value generation part configured to generate a command value of a first parameter including a rotational speed of the table; and a second command value generation part configured to generate a command value of a second parameter including at least a rotational speed of the rotary classifier, the first command value generation part being configured to determine the command value of the first parameter, based on a sum of a first basic command value determined in accordance with at least a coal supply amount command to the coal pulverizing apparatus, and a first preceding signal determined in accordance with at least a load change rate of load information of a combustion device which burns the pulverized coal from the coal pulverizing apparatus, the second command value generation part being configured to determine the command value of the second parameter, based on a sum of a second basic command value determined in accordance with at least the coal supply amount command, and a second preceding signal determined in accordance with at least the load change rate, the first command value generation part being configured to generate the first preceding signal having a positive or negative sign identical to that of the load change rate, the second command value generation part being configured to generate the second preceding signal having a positive or negative sign opposite to that of the load change rate.

2. The control device for a coal pulverizing apparatus according to claim 1, wherein the first command value generation part is configured to, when a load of the combustion device increases, increase the first basic command value with an increase in the coal supply amount command and generate the first preceding signal having a positive sign, and wherein the second command value generation part is configured to, when the load of the combustion device increases, increase the second basic command value with an increase in the coal supply amount command and generate the second preceding signal having a negative sign.

3. The control device for a coal pulverizing apparatus according to claim 1, wherein the first command value generation part is configured to generate the first preceding signal, based on a product of a first reference preceding signal which increases with an increase in the coal supply amount command, an operation coefficient determined based on at least one of a magnitude of a load of the combustion device or a load change range of the combustion device, and an operation coefficient having a sign identical to that of the load change rate, and wherein the second command value generation part is configured to generate the second preceding signal, based on a product of a second reference preceding signal which increases with the increase in the coal supply amount command, an operation coefficient determined based on at least one of the magnitude of the load of the combustion device or the load change range of the combustion device, and an operation coefficient having a sign opposite to that of the load change rate.

4. A control device for a coal pulverizing apparatus, the coal pulverizing apparatus including a rotatable table, a roller configured to pulverize a coal supplied from the table, a rotary classifier configured to classify a pulverized coal obtained by pulverizing the coal with the roller, and an air supply part configured to generate an air flow for guiding the pulverized coal toward the rotary classifier, the control device comprising:

a first command value generation part configured to generate a command value of a first parameter including a rotational speed of the table; and a second command value generation part configured to generate a command value of a second parameter including at least a rotational speed of the rotary classifier, the first command value generation part being configured to determine the command value of the first parameter, based on a sum of a first basic command value determined in accordance with at least a coal supply amount command to the coal pulverizing apparatus, and a first preceding signal determined in accordance with at least load information of a combustion device which burns the pulverized coal from the coal pulverizing apparatus, the second command value generation part being configured to determine the command value of the second parameter, based on a sum of a second basic command value determined in accordance with at least the coal supply amount command to the coal pulverizing apparatus, and a second preceding signal determined in accordance with at least the load information, wherein the first command value generation part is configured to determine the first preceding signal, based on a change rate of the command value of the second parameter.

5. The control device for a coal pulverizing apparatus according to claim 4, wherein the first command value generation part is configured to determine the first preceding signal so that a change rate of the first preceding signal is equal to or below a first rate limit determined based on the change rate of the command value of the second parameter.

6. A control device for a coal pulverizing apparatus, the coal pulverizing apparatus including a rotatable table, a roller configured to pulverize a coal supplied from the table, a rotary classifier configured to classify a pulverized coal obtained by pulverizing the coal with the roller, and an air supply part configured to generate an air flow for guiding the pulverized coal toward the rotary classifier, the control device comprising:

a first command value generation part configured to generate a command value of a first parameter including a rotational speed of the table; and a second command value generation part configured to generate a command value of a second parameter including at least a rotational speed of the rotary classifier, the first command value generation part being configured to determine the command value of the first parameter, based on a sum of a first basic command value determined in accordance with at least a coal supply amount command to the coal pulverizing apparatus, and a first preceding signal determined in accordance with at least load information of a combustion device which burns the pulverized coal from the coal pulverizing apparatus, the second command value generation part being configured to determine the command value of the second parameter, based on a sum of a second basic command value determined in accordance with at least the coal supply amount command to the coal pulverizing apparatus, and a second preceding signal determined in accordance with at least the load information, wherein the second command value generation part is configured to determine the second preceding signal, based on a change rate of the command value of the first parameter.

7. The control device for a coal pulverizing apparatus according to claim 6, wherein the second command value generation part is configured to determine the second preceding signal so that a change rate of the second preceding signal is equal to or below a second rate limit determined based on the change rate of the command value of the first parameter.

8. The control device for a coal pulverizing apparatus according to claim 1, wherein the first command value generation part is configured to determine the first preceding signal in accordance with the load information and raw-material-coal characteristic information related to a characteristic of a raw material coal.

9. The control device for a coal pulverizing apparatus according to claim 1, wherein the second command value generation part is configured to determine the second preceding signal in accordance with the load information and raw-material-coal characteristic information related to a characteristic of a raw material coal.

10. The control device for a coal pulverizing apparatus according to claim 8, wherein the raw-material-coal characteristic information includes a water content of the raw material coal.

11. A coal pulverizing apparatus comprising:

a rotatable table;

a roller configured to pulverize a coal supplied from the table;

an actuator configured to press the roller to the table;

a rotary classifier configured to classify a pulverized coal obtained by pulverizing the coal with the roller;

an air supply part configured to generate an air flow for guiding the pulverized coal toward the rotary classifier; and the control device according to claim 1 configured to control the rotary classifier and at least one of the table, the actuator, or the air supply part.

12. A coal-fired power plant comprising:

the coal pulverizing apparatus according to claim 11;

a boiler configured to burn the pulverized coal from the coal pulverizing apparatus to generate steam;

a steam turbine configured to be driven by the steam generated from the boiler; and a generator configured to be driven by the steam turbine.

13. A control method for a coal pulverizing apparatus including a rotatable table, a roller configured to pulverize a coal supplied from the table, a rotary classifier configured to classify a pulverized coal obtained by pulverizing the coal with the roller, and an air supply part configured to generate an air flow for guiding the pulverized coal toward the rotary classifier, the control method comprising:

a first command value generation step of generating a command value of a first parameter including a rotational speed of the table;

a second command value generation step of generating a command value of a second parameter including at least a rotational speed of the rotary classifier, the first command value generation step including determining the command value of the first parameter, based on a sum of a first basic command value determined in accordance with at least a coal supply amount command to the coal pulverizing apparatus, and a first preceding signal determined in accordance with at least a load change rate of load information of a combustion device which burns the pulverized coal from the coal pulverizing apparatus, the second command value generation step including determining the command value of the second parameter, based on a sum of a second basic command value determined in accordance with at least the coal supply amount command to the coal pulverizing apparatus, and a second preceding signal determined in accordance with at least the load change rate, the first preceding signal having a positive or negative sign identical to that of the load change rate, the second preceding signal having a positive or genitive sign opposite to that of the load change rate.

14. The control device for a coal pulverizing apparatus according to claim 9, wherein the raw-material-coal characteristic information includes a water content of the raw material coal.

* * * * *